US011788719B1

(12) United States Patent
Lu

(10) Patent No.: US 11,788,719 B1
(45) Date of Patent: Oct. 17, 2023

(54) WATER-PROOF MODULARIZED LIGHTING DEVICE

(71) Applicant: Shinegrow (Xiamen) Lighting Technology Co., LTD., Fujian (CN)

(72) Inventor: Fuxing Lu, Fujian (CN)

(73) Assignee: Shinegrow (Xiamen) Lighting Technology Co., LTD., Fujian (CN)

( * ) Notice: Subject to any disclaimer, the term of this patent is extended or adjusted under 35 U.S.C. 154(b) by 0 days.

(21) Appl. No.: 18/122,146

(22) Filed: Mar. 16, 2023

(30) Foreign Application Priority Data

Aug. 19, 2022 (CN) ..... 202222195300.2
Aug. 19, 2022 (CN) ..... 202222196617.8

(51) Int. Cl.
*F21V 31/00* (2006.01)
*F21S 2/00* (2016.01)
*F21V 15/015* (2006.01)
*F21V 31/03* (2006.01)

(52) U.S. Cl.
CPC ..... *F21V 31/005* (2013.01); *F21S 2/005* (2013.01); *F21V 15/015* (2013.01); *F21V 31/03* (2013.01)

(58) Field of Classification Search
CPC ..... F21V 31/005; F21V 31/03; F21V 15/015; F21S 2/005
See application file for complete search history.

(56) References Cited

U.S. PATENT DOCUMENTS 8,021,016 B2 * 9/2011 Ward ..... F21K 9/27 362/240
9,163,808 B1 * 10/2015 Lehman ..... F21V 29/83
10,648,643 B2 * 5/2020 Edmond ..... F21V 7/005
10,788,176 B2 * 9/2020 Medendorp, Jr. ..... F21V 21/02
2013/0242550 A1 * 9/2013 Suen ..... F21V 29/673 29/592.1
2022/0107062 A1 * 4/2022 Monsonego ..... F21V 21/005
2023/0194059 A1 * 6/2023 Yaphe ..... F21V 21/005 362/249.01

* cited by examiner

*Primary Examiner* — Arman B Fallahkhair
(74) *Attorney, Agent, or Firm* — Winston Hsu

(57) ABSTRACT

A water-proof modularized lighting device includes a light source module and a frame. The light source module includes a housing and two end caps disposed at the two ends thereof respectively. Each end cap includes a base having an accommodating space and two connecting sheets fixed at the bottom thereof. The frame includes two electrical connecting modules. Each electrical connecting module includes an installation base and two clamping structures. The installation base has an installation space, a central drainage channel and two lateral drainage channels. The clamping structures are disposed at the bottom of the installation space. The central drainage channel and the lateral drainage channels surround the installation space. The end caps are detachably installed at the electrical connecting modules respectively, such that the connecting sheets of each end cap are inserted into the clamping structures of the electrical connecting module corresponding thereto.

10 Claims, 6 Drawing Sheets

WATER-PROOF MODULARIZED LIGHTING DEVICE

BACKGROUND OF THE INVENTION

1. Field of the Invention

The present invention relates to a lighting device, in particular to a water-proof modularized lighting device.

2. Description of the Prior Art

Most of currently available lighting products are integrated-type lighting devices. If a currently available lighting device malfunctions, it is necessary to replace the lighting device by another one or remove lighting device for repairing. For the same reason, the transportation cost and storage cost of these lighting devices cannot be effectively reduced.

Besides, some buildings or workplaces require the lighting devices with water-proof function. However, the water-proof performance of many currently available lighting devices still needs to be further improved, so these lighting devices may malfunction in humid environment, which cannot meet actual requirements.

SUMMARY OF THE INVENTION

One embodiment of the present invention provides a water-proof modularized lighting device, which includes a light source module and a frame. The light source module includes a housing and two end caps disposed at the two ends of the housing respectively. Each of the end caps includes a base having an accommodating space and two connecting sheets fixed at the bottom of the accommodating space. The frame includes two electrical connecting modules. Each of the electrical connecting modules includes an installation base and two clamping structures. The installation base has an installation space, a central drainage channel and two lateral drainage channels. The two clamping structures are disposed at the bottom of the installation space. The central drainage channel and the two lateral drainage channels surround the installation space. The two end caps are detachably installed at the two electrical connecting modules respectively, such that the two connecting sheets of each of the end caps are inserted into the two clamping structures of the electrical connecting module corresponding thereto.

In one embodiment, each of the two end caps further includes a water-proof ring disposed at the bottom of the accommodating space and surrounding the two connecting sheets.

In one embodiment, the central drainage channel and the two lateral drainage channels surround the water-proof ring.

In one embodiment, the light source module further includes a light source board disposed in the housing and the two connecting sheets are electrically connected to the light source board via the base.

In one embodiment, the light source module is fixed in the housing via a fixation member.

In one embodiment, the water-proof modularized lighting device further includes a power source module disposed in the frame and electrically connected to the two clamping structures of each of the electrical connecting modules.

In one embodiment, the light source board includes a circuit board and a plurality of light emitting units disposed on the circuit board.

In one embodiment, the light source board is fixed on an installation surface of the housing via a fixation member. The installation surface has a guidance groove and the fixation member penetrates through the light source board and the guidance groove.

In one embodiment, the guidance groove has two slopes of equal length and the included angle between the two slopes is greater than 90°.

In one embodiment, each of the end caps further includes two snapping mechanisms disposed at the two sides of the base respectively. The end cap is detachably installed on the electrical connecting module corresponding thereto via the two snapping mechanisms.

The water-proof modularized lighting device in accordance with the embodiments of the present invention may have the following advantages:

(1) In one embodiment of the present invention, the water-proof modularized lighting device integrates a water-proof structure with a drainage structure, which can greatly enhance the water-proof performance of the modularized lighting device so as to reduce the failure rate of the water-proof modularized lighting device when the water-proof modularized lighting device is used in humid environment. Accordingly, the water-proof modularized lighting device can satisfy actual requirements.

(2) In one embodiment of the present invention, the water-proof modularized lighting device has the modularized light source module and the modularized electrical connecting module. Thus, if any one of the light source modules or any one of the electrical connecting module malfunctions, the user can directly remove the light source module or electrical connecting module for maintenance or repairing, which can significantly reduce the maintenance cost.

(3) In one embodiment of the present invention, the water-proof modularized lighting device has the modularized light source module and the modularized electrical connecting module. Therefore, the modularized lighting device is not only convenient in transportation, but also can effectively save more storage space, which can greatly reduce the transportation cost and storage cost thereof.

(4) In one embodiment of the present invention, the water-proof modularized lighting device has the guidance groove, which can effectively avoid that the fines, generated when the fixation member penetrates through the light source board and the installation surface of the housing, accumulate between the light source board and the installation surface of the housing. Therefore, the contact area between the light source board and the installation surface of the housing can be maximized, such that the thermal conductivity efficiency between the light source board and the installation surface of the housing can be enhanced. Accordingly, the heat dissipation performance of the water-proof modularized lighting device can be effectively improved in order to further extend the service life of the water-proof modularized lighting device.

(5) In one embodiment of the present invention, the water-proof modularized lighting device has the guidance groove. The guidance groove has two slopes of equal length and the included angle between the slopes is greater than 90°. The above structure design can effectively avoid that the fines accumulate between the light source board and the installation surface so as to further enhance the water-proof performance of the water-proof modularized lighting device.

(6) In one embodiment of the present invention, the structure design of the water-proof modularized lighting device is simple, so the water-proof modularized lighting device can achieve the desired technical effects without significantly increasing the cost thereof. Thus, the water-proof modularized lighting device can have high commercial value.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

The present invention will become more fully understood from the detailed description given herein below and the accompanying drawings which are given by way of illustration only, and thus are not limitative of the present invention and wherein.

DETAILED DESCRIPTION

Figure 1:
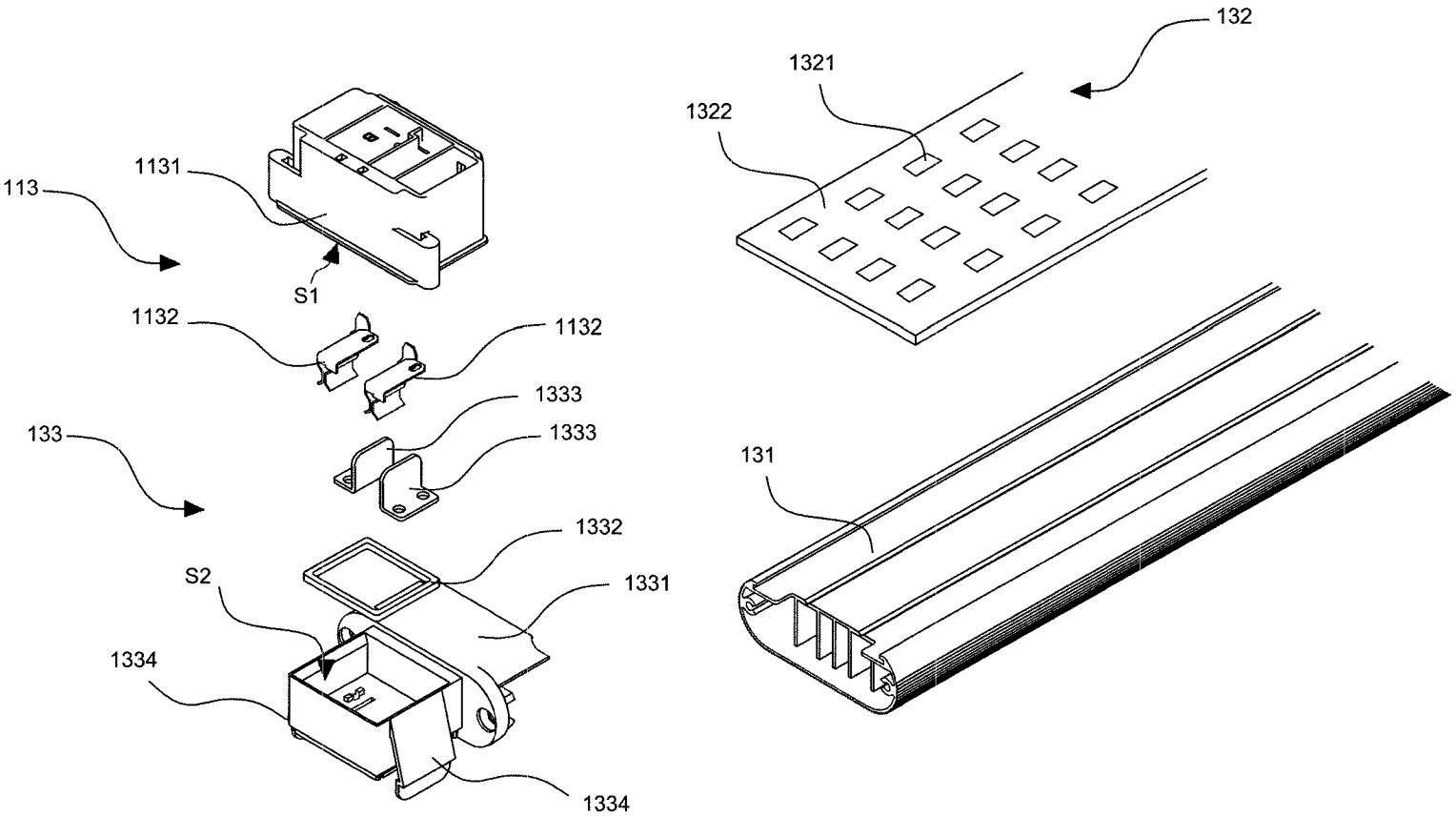
FIG. 1 is an exploded view of a water-proof modularized lighting device in accordance with one embodiment of the present invention.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing. It should be understood that, when it is described that an element is "coupled" or "connected" to another element, the element may be "directly coupled" or "directly connected" to the other element or "coupled" or "connected" to the other element through a third element. In contrast, it should be understood that, when it is described that an element is "directly coupled" or "directly connected" to another element, there are no intervening elements.

Figure 2:
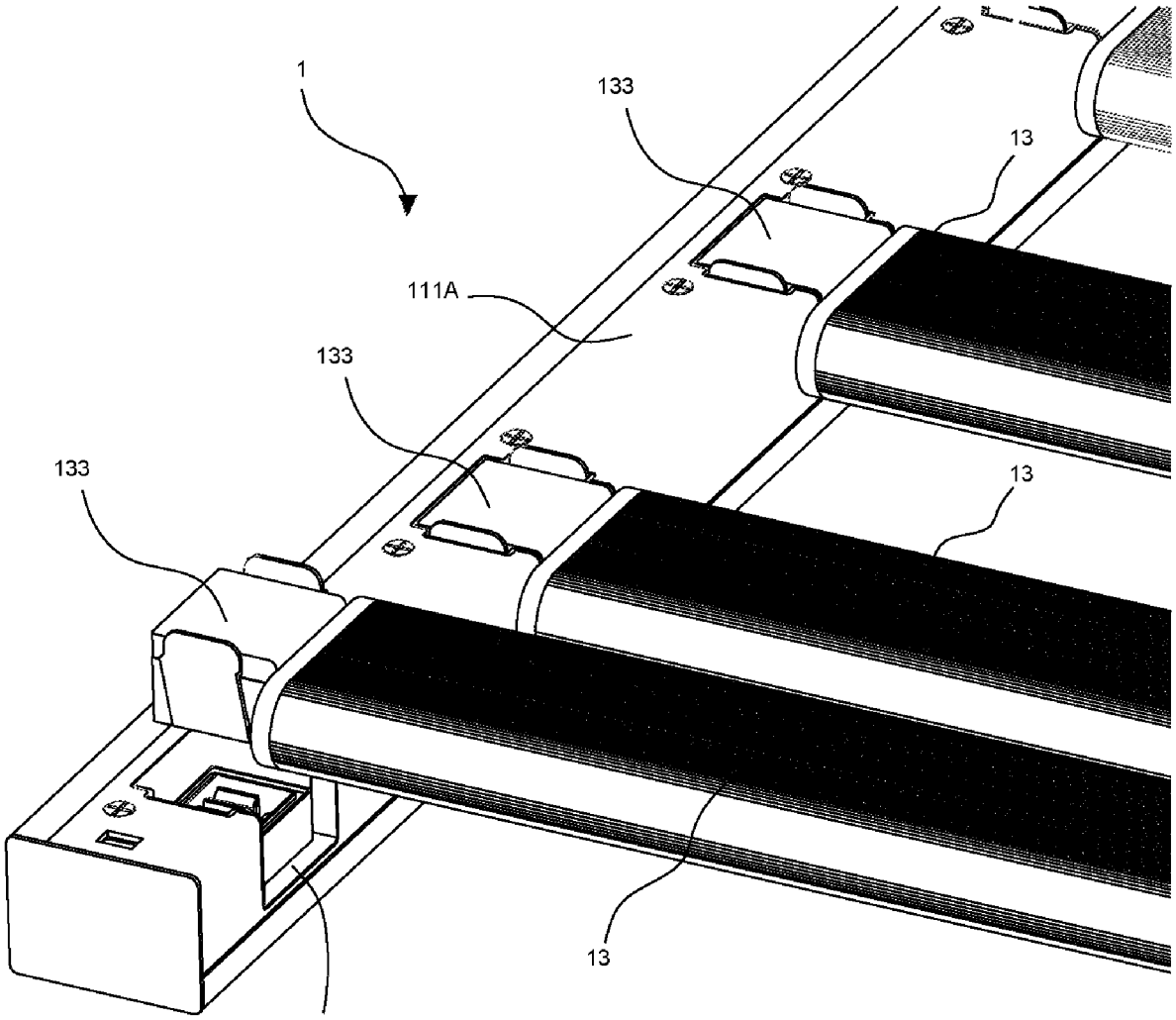
FIG. 2 is a partial enlargement view of the water-proof modularized lighting device in accordance with one embodiment of the present invention.
Figure 3:
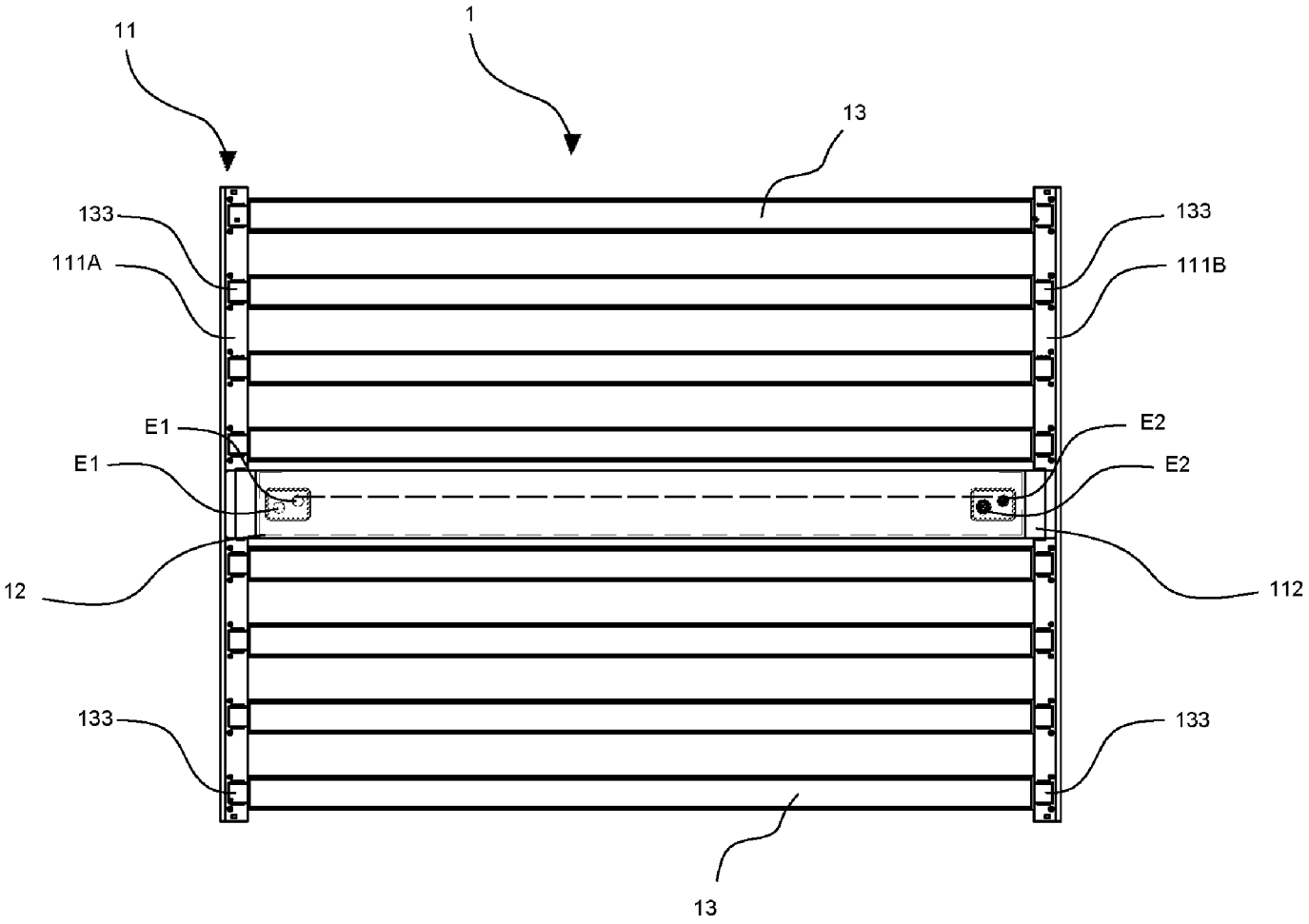
FIG. 3 is a top view of the water-proof modularized lighting device in accordance with one embodiment of the present invention.

Please refer to FIG. 1, FIG. 2 and FIG. 3. FIG. 1 is an exploded view of a water-proof modularized lighting device in accordance with one embodiment of the present invention. FIG. 2 is a partial enlargement view of the water-proof modularized lighting device in accordance with one embodiment of the present invention. FIG. 3 is a top view of the water-proof modularized lighting device in accordance with one embodiment of the present invention. As shown in FIG. 1, FIG. 2 and FIG. 3, the water-proof modularized lighting device 1 includes a frame 11, a power source module 12 and a plurality of light source module 13.

The frame 11 includes a first frame bar 111A, a second frame bar 111B, a connecting portion 112 and a plurality of electrical connecting modules 113. The first frame bar 111A is connected to the second frame bar 111B via the connecting portion 112. In one embodiment, the frame 11 may be made of a non-metallic material, such as plastics. In another embodiment, the frame 11 may be made of a metal material, such as aluminum, copper, stainless steel, etc. The above electrical connecting modules 113 are detachably disposed at the first frame bar 111A and the second frame bar 111B. Each electrical connecting module 113 includes an installation base 1131 and two clamping structures 1132. The installation base 1131 has an installation space S1 and the two clamping structures 1132 are disposed at the bottom of the installation space S1. As set forth above, the electrical connecting structure 113 has a modularized structure.

The above light source module 13 may be a modularized light source module and electrically connected to the power source module 12. One end of each of the light source modules 13 is fixed at the first frame bar 111A and the other end thereof is fixed at the second frame bar 111B, such that the light source modules 13 are parallel to each other. The above light source modules 13 may be detachably fixed at the first frame bar 111A and the second frame bar 111B.

Each light source module 13 includes a housing 131, a light source board 132 and two end caps 133. The light source board 132 is disposed in the housing 131. The light source board 132 includes a plurality of light-emitting units 1321 and a circuit board 1322. The light-emitting units 1321 are disposed on the circuit board 1322. In one embodiment, the light-emitting units 1321 may be light-emitting diodes (LED) or other currently available light sources.

The two end caps 133 are disposed at the two ends of the housing 131 respectively. Each of the end caps 133 includes a base 1331, a water-proof ring 1332, two connecting sheets 1333 and two snapping mechanisms (e.g., snap-fit hooks, snap arms, etc.) 1334. The base 1331 has an accommodating space S2. The two connecting sheets 1333 are fixed at the bottom of the accommodating space S2 and electrically connected to the light source board 132 via the base 1331. The water-proof ring 1332 is disposed at the bottom of the accommodating space S2 and surrounds the two connecting sheets 1333. The two end caps 132 of each light source module 13 are detachably installed on one of the electrical connecting modules 113 of the first frame bar 111A and one of the electrical connecting modules 113 of the second frame bar 111B respectively. The two connecting sheets 1333 of each end cap 133 are respectively inserted into the two clamping structures 1132 of the electrical connecting module 113 corresponding thereto. The connecting sheets 1333 may be made of a conductive material (e.g., aluminum, copper, phosphor bronze or other metal materials), so the connecting sheets 1333 can have great elasticity and electrical conductivity. The two snapping mechanisms 1334 are disposed at the two sides of the base 1331, such that the end cap 133 can be fixed at the electrical connecting module 113. If the user would like to replace one of the light source modules 13, the user can remove the end caps 133 of the light source module 13 by pressing the two snapping mechanisms 1334 of each of the end caps 133. Afterward, the user can install the two end caps 133 of another light source module 13 on the two electrical connecting modules 113 corresponding thereto, and then press the light source module 13 in the direction toward the two electrical connecting modules 113. Thus, this light source module 13 can be detachably fixed at the two electrical connecting modules 113 via the two snapping mechanisms 1334.

The power source module 12 is disposed in the frame 11 and electrically connected to the two clamping structures 1132 of each of the electrical connecting modules 113. In this embodiment, the power source module 12 is disposed in the connecting portion 112. In one embodiment, the power source module 12 may include one or more of a filter circuit, a rectifier circuit, a transformer circuit and a converter circuit. Via the above structure, the light source board 122 can be electrically connected to the power source module 12 via the base 1331, the two connecting sheets 1333 and the electrical connecting modules 113 (the two clamping structures 1132).

The modularized lighting device 1 has the modularized light source modules 13 and electrical connecting modules 113. Thus, if any one of the power source modules 13 or any one of the electrical connecting modules 113 malfunctions, the user can directly remove the light source module 13 or electrical connecting module 113 for maintenance or repairing. In addition, via the above structure design, the modularized lighting device 1 is not only convenient in transportation, but also can effectively save more storage space, which can greatly reduce the transportation cost and storage cost thereof.

The embodiment just exemplifies the present invention and is not intended to limit the scope of the present invention; any equivalent modification and variation according to the spirit of the present invention is to be also included within the scope of the following claims and their equivalents.

Figure 4:
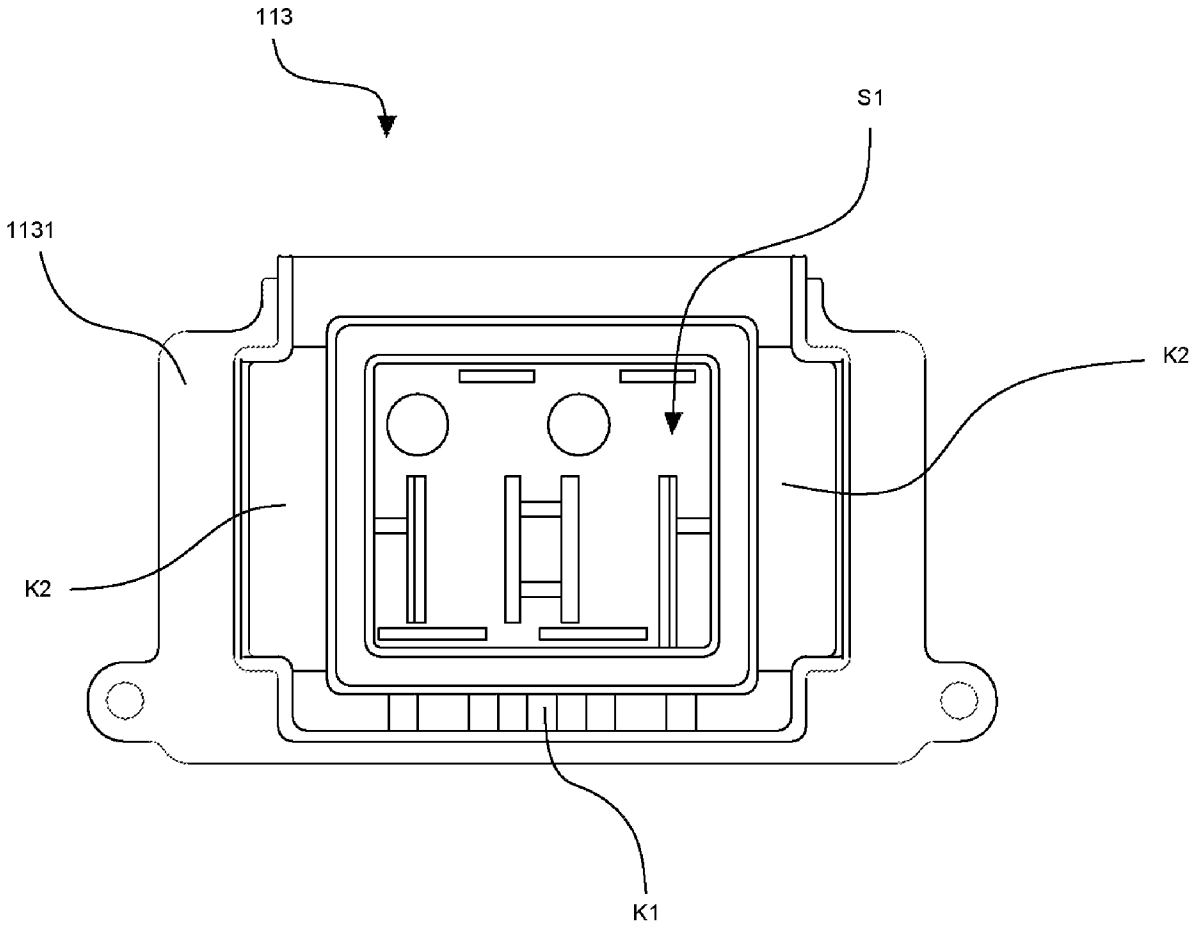
FIG. 4 is a top view of an electrical connecting module of a frame of the water-proof modularized lighting device in accordance with one embodiment of the present invention.

Please refer to FIG. 4, which is a top view of an electrical connecting module of a frame of the water-proof modularized lighting device in accordance with one embodiment of the present invention; please also refer to FIG. 1. As shown in FIG. 4, the installation base 1131 of the electrical connecting module 113 further has a central drainage channel K1 and two lateral drainage channels K2. The central drainage channel K1 and the two lateral drainage channels K2 are arranged to surround the installation space S1 and the water-proof ring 1332 (as shown in FIG. 1) inside the installation space S1. In this embodiment, the central drainage channel K1 may include a plurality of drainage sub-channels.

In this way, when the end cap 133 is installed on the electrical connecting module 113 corresponding thereto, the water-proof ring 1332, the base 1331 of the end cap 133 and the installation base 1131 of the electrical connecting module 113 can form an enclosed space in order to serve as a water-proof structure. In addition, the drainage structure formed by the central drainage channel K1 and the two lateral drainage channels K2 can effectively discharge water. The combination of the above water-proof structure and drainage structure can greatly enhance the water-proof performance of the water-proof modularized lighting device 1 with a view to reducing the failure rate thereof.

The embodiment just exemplifies the present invention and is not intended to limit the scope of the present invention; any equivalent modification and variation according to the spirit of the present invention is to be also included within the scope of the following claims and their equivalents.

It is worthy to point out that some buildings or workplaces require the lighting devices with water-proof function. However, the water-proof performance of many currently available lighting devices still needs to be further improved, so these lighting devices may malfunction in humid environment, which cannot meet actual requirements. On the contrary, according to one embodiment of the present invention, the water-proof modularized lighting device integrates a water-proof structure with a drainage structure, which can greatly enhance the water-proof performance of the modularized lighting device so as to reduce the failure rate of the water-proof modularized lighting device when the water-proof modularized lighting device is used in humid environment. Accordingly, the water-proof modularized lighting device can satisfy actual requirements.

Besides, most of currently available lighting products are integrated-type lighting devices. If a currently available lighting device malfunctions, it is necessary to replace the lighting device by another one or remove lighting device for repairing. For the same reason, the transportation cost and storage cost of these lighting devices cannot be effectively reduced. On the contrary, according to one embodiment of the present invention, the water-proof modularized lighting device has the modularized light source module and the modularized electrical connecting module. Thus, if any one of the light source modules or any one of the electrical connecting module malfunctions, the user can directly remove the light source module or electrical connecting module for maintenance or repairing, which can significantly reduce the maintenance cost.

Also, according to one embodiment of the present invention, the water-proof modularized lighting device has the modularized light source module and the modularized electrical connecting module. Therefore, the modularized lighting device is not only convenient in transportation, but also can effectively save more storage space, which can greatly reduce the transportation cost and storage cost thereof.

Further, according to one embodiment of the present invention, the water-proof modularized lighting device has the guidance groove, which can effectively avoid that the fines, generated when the fixation member penetrates through the light source board and the installation surface of the housing, accumulate between the light source board and the installation surface of the housing. Therefore, the contact area between the light source board and the installation surface of the housing can be maximized, such that the thermal conductivity efficiency between the light source board and the installation surface of the housing can be enhanced. Accordingly, the heat dissipation performance of the water-proof modularized lighting device can be effectively improved in order to further extend the service life of the water-proof modularized lighting device.

Moreover, according to one embodiment of the present invention, the water-proof modularized lighting device has the guidance groove. The guidance groove has two slopes of equal length and the included angle between the slopes is greater than 90°. The above structure design can effectively avoid that the fines accumulate between the light source board and the installation surface so as to further enhance the water-proof performance of the water-proof modularized lighting device.

Furthermore, according to one embodiment of the present invention, the structure design of the water-proof modularized lighting device is simple, so the water-proof modularized lighting device can achieve the desired technical effects without significantly increasing the cost thereof. Thus, the water-proof modularized lighting device can have high commercial value. As set forth above, the water-proof modularized lighting device according to the embodiments can definitely achieve the desired technical effects.

Figure 5B:
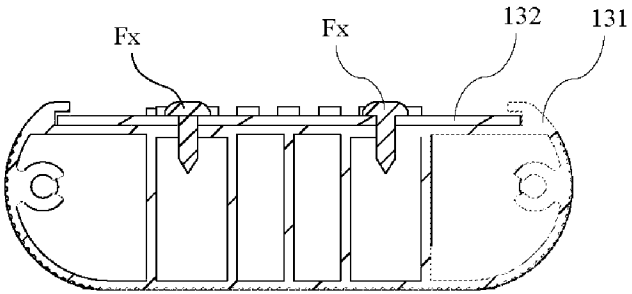
FIG. 5B is a second sectional view of the water-proof modularized lighting device in accordance with one embodiment of the present invention.
Figure 5A:
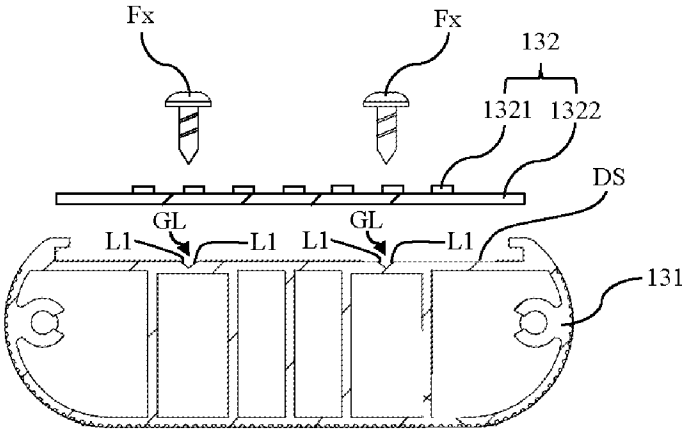
FIG. 5A is a first sectional view of the water-proof modularized lighting device in accordance with one embodiment of the present invention.
Figure 6:
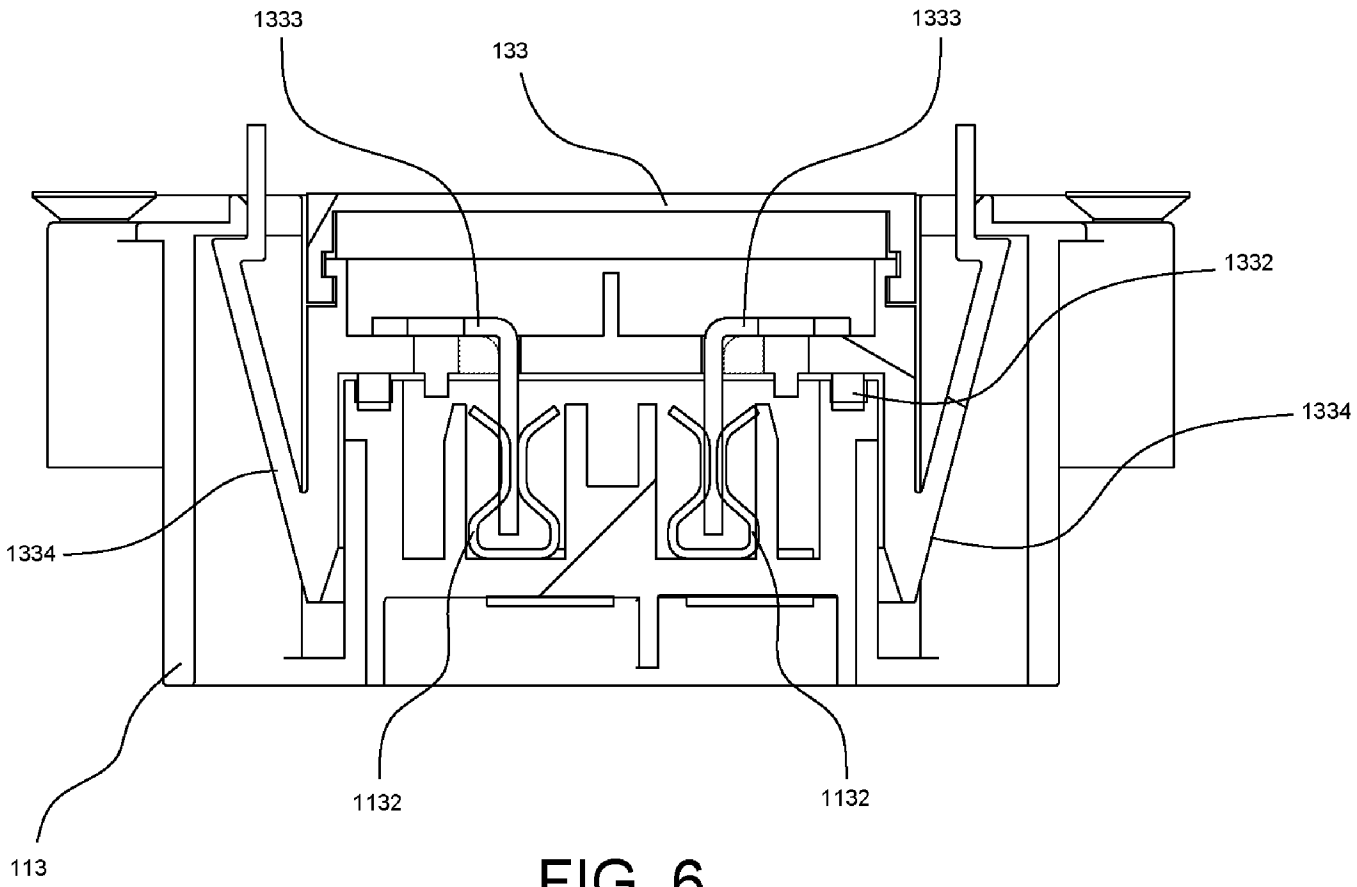
FIG. 6 is a third sectional view of the water-proof modularized lighting device in accordance with one embodiment of the present invention.

Please refer to FIG. 5A, FIG. 5B and FIG. 6. FIG. 5A is a first sectional view of the water-proof modularized lighting device in accordance with one embodiment of the present invention. FIG. 5B is a second sectional view of the water-proof modularized lighting device in accordance with one embodiment of the present invention. FIG. 6 is a third sectional view of the water-proof modularized lighting device in accordance with one embodiment of the present invention. Please also refer to FIG. 1~FIG. 4. As shown in FIG. 5A and FIG. 5B, the light source board 132 is disposed in the housing 131 and fixed on the installation surface DS of the housing 131 via a plurality of fixation members Fx. The light source board 132 includes a plurality of light-emitting units 1321 and a circuit board 1322, and the lighting-emitting units 1321 are disposed on the circuit board 1322. In this embodiment, the fixation members Fx are screws. In another embodiment, the fixation members Fx may be other similar components.

The installation surface Ds of the housing 131 is provided with several guidance grooves GL and the fixation members Fx penetrate through the light source board 132 and the guidance grooves GL respectively. Each guidance groove GL has two slopes L1 of equal length and the included angle between the slopes L1 is greater than 90° (e.g., 100°, 110°, etc.). the structure design of the guidance groove GL can effectively prevent the fines, generated when the user tightens up the fixation members Fx, from moving toward the installation surface DS of the housing 131. Therefore, the above structure can effectively avoid that the fines accumulate between the light source board 132 and the installation surface DS of the housing 131.

As shown in FIG. 6, the two connecting sheets 1333 of the end cap 133 are respectively inserted into the two clamping structures 1132 of the electrical connecting module 113. The clamping structures 1132 may be made of a material with great elasticity and electrical conductivity (e.g., aluminum, copper, phosphor bronze or other metal materials), such that the clamping structures 1132 can have great elasticity and electrical conductivity. In this way, the clamping structures 1132 can provide proper clamping force for the connecting sheets 1333.

The embodiment just exemplifies the present invention and is not intended to limit the scope of the present invention; any equivalent modification and variation according to the spirit of the present invention is to be also included within the scope of the following claims and their equivalents.

According to one embodiment of the present invention, the water-proof modularized lighting device integrates a water-proof structure with a drainage structure, which can greatly enhance the water-proof performance of the modularized lighting device so as to reduce the failure rate of the water-proof modularized lighting device when the water-proof modularized lighting device is used in humid environment. Accordingly, the water-proof modularized lighting device can satisfy actual requirements.

According to one embodiment of the present invention, the water-proof modularized lighting device has the modularized light source module and the modularized electrical connecting module. Thus, if any one of the light source modules or any one of the electrical connecting module malfunctions, the user can directly remove the light source module or electrical connecting module for maintenance or repairing, which can significantly reduce the maintenance cost.

Also, according to one embodiment of the present invention, the water-proof modularized lighting device has the modularized light source module and the modularized electrical connecting module. Therefore, the modularized lighting device is not only convenient in transportation, but also can effectively save more storage space, which can greatly reduce the transportation cost and storage cost thereof.

Further, according to one embodiment of the present invention, the water-proof modularized lighting device has the guidance groove, which can effectively avoid that the fines, generated when the fixation member penetrates through the light source board and the installation surface of the housing, accumulate between the light source board and the installation surface of the housing. Therefore, the contact area between the light source board and the installation surface of the housing can be maximized, such that the thermal conductivity efficiency between the light source board and the installation surface of the housing can be enhanced. Accordingly, the heat dissipation performance of the water-proof modularized lighting device can be effectively improved in order to further extend the service life of the water-proof modularized lighting device.

Moreover, according to one embodiment of the present invention, the water-proof modularized lighting device has the guidance groove. The guidance groove has two slopes of equal length and the included angle between the slopes is greater than 90°. The above structure design can effectively avoid that the fines accumulate between the light source board and the installation surface so as to further enhance the water-proof performance of the water-proof modularized lighting device.

Furthermore, according to one embodiment of the present invention, the structure design of the water-proof modularized lighting device is simple, so the water-proof modularized lighting device can achieve the desired technical effects without significantly increasing the cost thereof. Thus, the water-proof modularized lighting device can have high commercial value.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A water-proof modularized lighting device, comprising:

a light source module comprising a housing and two end caps disposed at two ends of the housing respectively, wherein each of the end caps comprises a base having an accommodating space and two connecting sheets fixed at a bottom of the accommodating space; and a frame comprising two electrical connecting modules, wherein each of the electrical connecting modules comprises an installation base and two clamping structures, and the installation base has an installation space, a central drainage channel and two lateral drainage channels, and the two clamping structures are disposed at a bottom of the installation space, wherein the central drainage channel and the two lateral drainage channels surround the installation space;

wherein the two end caps are detachably installed at the two electrical connecting modules respectively, whereby the two connecting sheets of each of the end caps are inserted into the two clamping structures of the electrical connecting module corresponding thereto.

2. The water-proof modularized lighting device as claimed in claim 1, wherein the light source module further comprises a light source board disposed in the housing and the two connecting sheets are electrically connected to the light source board via the base.

3. The water-proof modularized lighting device as claimed in claim 2, wherein the light source board is fixed on an installation surface of the housing via a fixation member, wherein the installation surface has a guidance groove and the fixation member penetrates through the light source board and the guidance groove.

4. The water-proof modularized lighting device as claimed in claim 3, wherein the guidance groove has two slopes of equal length and an included angle between the two slopes is greater than 90°.

5. The water-proof modularized lighting device as claimed in claim 2, wherein the light source module is fixed in the housing via a fixation member.

6. The water-proof modularized lighting device as claimed in claim 2, further comprising a power source module disposed in the frame and electrically connected to the two clamping structures of each of the electrical connecting modules.

7. The water-proof modularized lighting device as claimed in claim 2, wherein the light source board comprises a circuit board and a plurality of light emitting units disposed on the circuit board.

8. The water-proof modularized lighting device as claimed in claim 1, wherein each of the two end caps further comprises a water-proof ring disposed at the bottom of the accommodating space and surrounding the two connecting sheets.

9. The water-proof modularized lighting device as claimed in claim 8, wherein the central drainage channel and the two lateral drainage channels surround the water-proof ring.

10. The water-proof modularized lighting device as claimed in claim 1, wherein each of the end caps further comprises two snapping mechanisms disposed at two sides of the base respectively, and the end cap is detachably installed on the electrical connecting module corresponding thereto via the two snapping mechanisms.

* * * * *